US009567752B2

(12) United States Patent
McCandless et al.

(10) Patent No.: US 9,567,752 B2
(45) Date of Patent: Feb. 14, 2017

(54) FACADE

(71) Applicant: James Hardie Technology Limited, Dublin (IE)

(72) Inventors: Jeremy McCandless, Sydney (AU); James Gleeson, Sydney (AU)

(73) Assignee: James Hardie Technology Limited, Dublin (IE)

( * ) Notice: Subject to any disclaimer, the term of this patent is extended or adjusted under 35 U.S.C. 154(b) by 0 days.

(21) Appl. No.: 14/367,848

(22) PCT Filed: Dec. 20, 2012

(86) PCT No.: PCT/EP2012/076364

§ 371 (c)(1),
(2) Date: Jun. 20, 2014

(87) PCT Pub. No.: WO2013/092848

PCT Pub. Date: Jun. 27, 2013

(65) Prior Publication Data

US 2015/0096251 A1 Apr. 9, 2015

(30) Foreign Application Priority Data

Dec. 21, 2011 (GB) ..... 1122059.7

(51) Int. Cl.
*E04B 2/00* (2006.01)
*E04F 13/00* (2006.01)
(Continued)

(52) U.S. Cl.
CPC ..... *E04F 13/007* (2013.01); *E04B 1/40* (2013.01); *E04B 1/62* (2013.01); *E04B 1/625* (2013.01);
(Continued)

(58) Field of Classification Search
CPC ..... E04F 13/007; E04F 13/25; E04F 13/141; E04F 13/23; E04F 13/0803; E04F 13/0889; E04B 1/62; E04B 1/40; E04B 1/625; E04B 2001/405
(Continued)

(56) References Cited

U.S. PATENT DOCUMENTS 3,550,337 A * 12/1970 Lorenz ..... 52/136
3,936,986 A * 2/1976 Steel ..... 52/235
(Continued)

FOREIGN PATENT DOCUMENTS

DE 20 41 698 5/1972
DE 199 55 631 6/2001
(Continued)

OTHER PUBLICATIONS

International Preliminary Report on Patentability for corresponding PCT Application No. PCT/EP2012/076364, filed Dec. 20, 2012, dated Jul. 31, 2014, 6 pages.
(Continued)

*Primary Examiner* — Basil Katcheves
*Assistant Examiner* — Joshua Ihezie
(74) *Attorney, Agent, or Firm* — Knobbe Martens Olson & Bear LLP

(57) ABSTRACT

A façade (100) comprising at least one façade panel (112) having a front face (131) and a rear face (113) and at least two panel support elements (108). Each panel support element (108) comprises a first arm (110), a second arm (109) wherein at least a portion of the second arm (109) is attached to the rear face (113) of the façade panel (112). The panel support element (108) also comprising at least two panel retaining elements (101), each comprising a first flange (104) and a channel 106, wherein at least a portion of the second arm (109) of the panel support element (108) is
(Continued)

restrained within the channel (106) and each panel retaining element (101) is attached to a building structural substrate (102).

35 Claims, 12 Drawing Sheets

(51) Int. Cl.

| | |
|---|---|
| ***E04F 13/08*** | (2006.01) |
| ***E04F 13/16*** | (2006.01) |
| ***E04B 1/41*** | (2006.01) |
| ***E04B 1/62*** | (2006.01) |
| ***E04F 13/14*** | (2006.01) |
| ***E04F 13/23*** | (2006.01) |
| ***E04F 13/25*** | (2006.01) |
| *E04B 1/38* | (2006.01) |

(52) U.S. Cl.
CPC ..... *E04F 13/083* (2013.01); *E04F 13/0807* (2013.01); *E04F 13/0814* (2013.01); *E04F 13/0875* (2013.01); *E04F 13/141* (2013.01); *E04F 13/16* (2013.01); *E04F 13/23* (2013.01); *E04F 13/25* (2013.01); *E04B 2001/405* (2013.01)

(58) Field of Classification Search
USPC ..... 52/506.01, 506.06, 506.08
See application file for complete search history.

(56) References Cited

U.S. PATENT DOCUMENTS

| | | | | |
|---|---|---|---|---|
| 4,070,835 | A * | 1/1978 | Reverend | E04F 13/0816 52/126.1 |
| 5,069,014 | A * | 12/1991 | Kubbutat | E04F 13/0812 52/235 |
| 5,220,758 | A * | 6/1993 | Stommel | 52/235 |
| 5,301,484 | A * | 4/1994 | Jansson | 52/235 |
| 5,673,529 | A * | 10/1997 | Treister | E04C 2/288 52/235 |
| 5,881,522 | A * | 3/1999 | Dobija | 52/506.01 |
| 6,098,364 | A * | 8/2000 | Liu | 52/506.08 |
| 6,170,214 | B1 * | 1/2001 | Treister et al. | 52/511 |
| 6,226,947 | B1 * | 5/2001 | Bado | E04F 13/0805 52/235 |
| 6,247,280 | B1 * | 6/2001 | Grinshpun | E04B 2/8635 52/309.12 |
| 6,289,646 | B1 * | 9/2001 | Watanabe | 52/506.01 |
| 6,748,709 | B1 * | 6/2004 | Sherman et al. | 52/235 |
| 6,792,727 | B2 * | 9/2004 | Krieger | 52/245 |
| 6,895,721 | B2 * | 5/2005 | Watanabe | E04F 13/0816 52/476 |
| 7,596,911 | B2 * | 10/2009 | Turco | 52/127.6 |
| 7,726,083 | B2 * | 6/2010 | Wagner | 52/235 |
| 8,051,623 | B2 * | 11/2011 | Loyd | 52/747.1 |
| 8,341,917 | B2 * | 1/2013 | Resso et al. | 52/741.4 |
| 8,468,765 | B1 * | 6/2013 | Kim | 52/506.06 |
| 8,745,941 | B2 * | 6/2014 | Macdonald et al. | 52/235 |
| 8,769,901 | B2 * | 7/2014 | Todd | E04F 13/0805 52/302.1 |
| 8,898,975 | B2 * | 12/2014 | Tsai | 52/235 |
| 8,984,838 | B2 * | 3/2015 | Bordener | 52/573.1 |
| 9,140,007 | B2 * | 9/2015 | Beaty | E04B 2/16 |
| 2004/0010998 | A1 * | 1/2004 | Turco | 52/762 |
| 2010/0199585 | A1 * | 8/2010 | Stevens et al. | 52/475.1 |
| 2012/0216471 | A1 * | 8/2012 | Manser | E04B 1/4178 52/302.1 |

FOREIGN PATENT DOCUMENTS

| | | |
|---|---|---|
| FR | 2 902 124 | 12/2007 |
| NL | 76 528 C | 6/1954 |
| WO | WO 2013/092484 | 6/2013 |

OTHER PUBLICATIONS

International Search Report and Written Opinion for corresponding PCT Application No. PCT/EP2012/076364, filed Dec. 20, 2012, dated Jul. 15, 2013, 8 pages.

Written Opinion of the International Preliminary Examinging Authority for Corresponding PCT Application No. PCT/EP2012/076364, filed Dec. 20, 2012, dated Apr. 8, 2014, 5 pages.

* cited by examiner

FACADE

FIELD OF THE INVENTION

The present invention relates to a façade system and in particular to an exterior façade system suitable for use in building construction.

The invention has been developed primarily for use as an exterior façade cladding system suitable for use in building construction and will be described hereinafter with reference to this application. However, it will be appreciated that the invention is not limited to this particular field of use.

BACKGROUND OF THE INVENTION

Any discussion of the prior art throughout the specification should in no way be considered as an admission that such prior art is widely known or forms part of the common general knowledge in the field.

Façade systems for new buildings are widely known. Façade panels of various types of materials, including coated aluminium and polymer composite materials are fixed to a structural frame, generally a metal frame, to provide a weather tight exterior envelope on a building. Such panels are conventionally attached to the structural frame by face fixing through the panel using securing means such as nails, screws and the like. Such securing means require secondary on-site processing to provide an aesthetically pleasing finish. It is known to provide concealed fixing for panels in façade systems to avoid secondary on-site processing. The concealed fixing system usually utilises a clip or bracket system which is attachable to the rear face of the façade panel. However, the clip or bracket system only provides point supports to the panel. This can cause further difficulties in extreme weather conditions particularly when the façade panel is trimmed to fit specific wall dimensions.

Furthermore, whilst façade systems are effective when providing a weather tight exterior envelope they provide little or no thermal insulation performance. Exterior insulated foam systems are known for providing a thermally efficient exterior façade system, whereby a thick insulation layer is formed on the exterior of a budding structure and a thin layer of weatherproofing render is applied over a support mesh attached to the insulation. These systems are more effective at providing thermal insulation performance, but, if the screed is breached, they lose their ability to provide a weather tight exterior envelope resulting in water ingress causing a reduction in thermal performance and possible damage to building structural elements.

OBJECT OF THE INVENTION

It is an object of the present invention to provide an improved façade system that can be easily secured to a structural frame whilst also optionally providing a thermally efficient façade system.

SUMMARY OF THE INVENTION

According to the invention there is provided a façade system suitable for attaching to a structural substrate comprising:

at least one façade panel comprising a front face and a rear face and an edge member intermediate to and contiguous to the front face and the rear face, at least one panel support element having a first arm, a second arm and a bridging portion intermediate the first and second arm, wherein the first arm of the at least one panel support element is connected to the rear face of the at least one façade panel, and at least one panel retaining means comprising means for attaching the panel retaining means to the structural substrate and means for securing the at least one panel support element to the at least one panel retaining means, wherein the means for securing the at least one panel support element comprises a channel formation for retaining the second arm of the at least one panel support element.

The advantage of the present invention is that is provides an adjustable, concealed fix, façade system, that is easy to install. Conveniently the façade panels are mounted onto the at least one retaining element by means of a panel support element such that the front face of the façade panel forms the exterior component of the façade system.

It is acknowledged that the term 'comprise' may, under varying jurisdictions be provided with either an exclusive or inclusive meaning. For the purpose of this specification, the term comprise shall have an inclusive meaning that it should be taken to mean an inclusion of not only the listed components it directly references, but also other non-specified components. Accordingly, the term 'comprise' is to be attributed with as broad an interpretation as possible within any given jurisdiction and this rationale should also be used when the terms 'comprised' and/or 'comprising' are used.

It is to be understood that the terms 'panel retaining means' and 'retaining element' are used interchangeably throughout the specification to describe the means by which the façade panel is attached to a structural substrate.

In one embodiment of the invention, the channel formation of the panel retaining means comprise a first and second flange separated by an intermediate portion. Ideally the first and second flanges extend substantially parallel to each other. Accordingly in this embodiment of the invention, the first and second flanges of the retaining element and the intermediate portion form a U-shaped channel, whereby the flanges define the arms of the U-shaped channel and the intermediate portion defines the base of the U-shaped channel.

In a further embodiment of the invention the first flange is biased towards second flange forming a restricted portion of the channel formation. In use, when the second side arm of panel support element is urged into the restricted portion of channel, first flange is forced away from the second flange resulting in second flange acting as a resiliently biased spring on second side arm to retain it in its installed position.

Optionally, in a further embodiment of the invention the second flange terminates in a formation designed to increase resistance of fit of the second arm of panel support element. The formation can be of any suitable shape or size. An example, of such a formation is a detent.

In a further embodiment of the invention, the panel retaining means further comprises spacing means intermediate the panel retaining means and the structural substrate. In one embodiment of the invention, the spacing means comprises a structural support element and a structural spacer element.

In use, the structural support element is installed on the structural building substrate and projects therefrom. Examples of suitable structural support elements include, for example, bolts, chemical anchors, masonry anchors and the like. The structural spacer element is mounted onto the structural support element. Structural spacer elements comprise a hollow tube that is substantially made from for example non-metallic materials such as glass fibre filled polymers, polypropylene, wood composites, wood, mineral materials, mineral filled polymers, and the like. It is recognised that any material with a low thermal conductivity and sufficient structural strength to meet the requirements of static and dynamic loading encountered in installation and in service are suitable for use as either the structural spacer element and or structural support element.

In a further embodiment of the invention an optional spacer element comprising, for example, a rubber or polymeric washer, is placed over each structural support element before mounting the structural spacer element.

In a further embodiment of the invention each of the structural spacer element and structural support element are provided with mutually enageable threaded portions. Conveniently the structural spacer element is installed on the structural support element by rotating the structural space element threaded portion with the threaded portion on structural support element.

In an alternative embodiment of the invention the structural support element is integrally formed with the structural spacer element.

In a further embodiment of the invention, the spacing means further comprises a support bracket. Conveniently the support bracket is mountable over the protruding part of structural support element, thereby providing additional support to the spacing means of the façade system of the invention. In one embodiment of the invention the support bracket is fixed in place by bracket securing means such as mounting bolts which are secured directly into substrate.

In another embodiment of the invention, the support bracket is held in place by the combined positioning of the support bracket, structural support and the releasable engagement of the structural spacer element with the structural support element. Advantageously the bolts or tensioning screws can be used to adjust the tilt of support bracket to take into account any surface variability in the masonry wall or building substrate. In this way the support bracket is adjusted to ensure the required alignment of structural spacer element.

In a further embodiment of the invention there is provided a support plate intermediate the panel retaining means and the spacing means. The support plate of the invention comprises a support surface attached to a support shaft, wherein the panel retaining means are attachable to the support plate.

In a further embodiment of the invention the structural spacer element and support shaft have mutually engageably threaded portions which releasably engage with each other. Conveniently this feature enables the support plate to be wound in or out to allow for adjustment to the position of the support plate relative to the surface of structural substrate whilst also providing a substantially planar surface for mounting the retaining element. Optionally an additional locking means is provided on the support plate is provided to lock the support plate at the desired position and prevent movement during installation of façade panels.

In a further embodiment of the invention, the panel retaining means further comprises securing means to securely retain the second side arm of the panel support element in position within the channel formation of the panel retaining means.

In a further embodiment of the invention the panel support element is in the form of a "C" channel section. In a further embodiment of the invention, the central flange of the "C" channel section may be perforated to allow ventilation of at least the portion between the insulating material and rear face of each installed façade panel.

Conveniently the panel support element is positioned on the rear face of the façade panel such that there is a panel lip provided between the end of the first side arm and the edge member of the panel. The panel lip functions to provide an area between the panel support element and the panel edge so that the panel support element is not seen from the exterior face of the façade panel.

In a further embodiment of the invention multiple panel support elements are attached to the rear face of the façade panel to form a façade cassette.

In a further embodiment of the invention, there is provided two panel support elements for each façade panel, wherein the first and second side arms on the panel support members comprise a continuous member extending between the respective "C" channel sections.

In a further embodiment of the invention, the panel support element further comprises a connecting web between the first and second side arms parallel to and spaced apart from base member, thereby forming an enclosed box section. One advantage of the enclosed box section is that it provides an air channel which further improves the thermal efficiency of the façade system of the invention. It is to be understood that this is an optional feature and is not necessarily present in all embodiments of the panel support elements of the invention.

Optionally, one or more corner connectors comprising two lengths of material arranged at right angles relative to each other, such that the or each corner connector can be positioned within the enclosed box section of adjoining panel support members. The advantage of the corner connector is that it provides additional support and strength to the panel support elements when arranged together to form a façade cassette. In a further embodiment of the invention the interior of the box section and the corner connectors have complimentary engaging portions disposed on the surfaces of the interior of the box section and the corner connectors. The complimentary engaging portions are designed to engage with each other when the corner connector is inserted into the enclosed box section to retain the corner connector in place. Optionally sealant or adhesive can be used in isolation or in conjunction with the complimentary engaging portions to retain the corner connector in place in the box section.

In a further embodiment of the invention, the panel support element comprises capping means whereby the capping means are used to protect the edge member of the façade panel. In this embodiment of the invention, the panel support element comprises a "J" channel section wherein the short side of the "J" shaped channel comprises the first side arm and the elongate side of the "J" shaped channel comprises the second side arm of the panel support element, intermediate the first side arm and second side arm is provided a base member The panel support element comprising capping means further comprises a third side arm spaced apart from the first side arm and projecting orthogonally from base member thereby forming a second "U" shaped channel. Conveniently the first and third side arm are spaced apart an appropriate distance to enable a façade panel seat within the second "U" shaped channel. Optionally adhesive is placed within the second "U" shaped channel to secure the section of the façade panel seated within the second "U" shaped channel and thereby hold the façade panel in place. Optionally the third side arm comprises a recess on the surface of the arm remote from the "U" shaped channel. The recess acts as a capillary break for managing water ingress and preventing water migrating to the rear face of the panel.

In a further embodiment of the invention, the end of first side arm remote from base member comprises a resilient member in the form of a small protrusion or lip. The lip or protrusion is resiliently biased towards the third side arm to further support and retain a façade panel when in position in the panel support element. The lip or protrusion also serves to attach as a capillary break to manage water ingress.

Preferably, in one embodiment of the invention, the panel support member comprising capping means is used to surround or frame a façade panel such that the façade panel is enclosed by the panel support element forming a façade cassette. Conveniently, the ends of each adjacent panel support member are mitre cut to allow the respective members to seat together in an aesthetically pleasing manner. Conveniently the corner connectors of the invention can also be positioned within the enclosed box section of adjoining panel support members. The advantage of the corner connector is that it provides additional support and strength to the panel support elements when arranged together to form a façade cassette. In a further embodiment of the invention the panel support member comprising capping means can have a decorative surface effect applied as desired.

In a further embodiment of the invention the façade system further comprises insulating material positioned between the structural substrate and the rear face of the façade panel. It is to be understood that this is an optional addition to the façade system. Suitable insulating materials include foamed panelized insulating material, for example, polyurethane foamed panelized insulating material, mineral or glass wool or other suitable insulating materials. Conveniently, insulating material is provided with the appropriate thermal insulation performance as desired by the end user. The selected insulating material may be installed to substantially cover, for example a wall section of building substrate that is to be clad by the façade system of the invention. It is preferable that no gaps are left between the insulating material and the structural building substrate that may detract from thermal performance of the completed façade. The advantage of the insulating material is that it enhances the thermal performance of the façade system of the invention. Conveniently the present invention incorporates a thermal conduction discontinuity for minimizing or substantially eliminating direct thermal conductivity between the façade face and the building structural substrate.

In a further embodiment of the invention the insulation material is supported by the bridging portion between the first and second side arms of the panel support element.

In a further embodiment of the invention wherein spacing means are used, insulating material is positioned such that it butts up against the structural spacer element.

In a further embodiment of the invention, building wrap is optionally installed over the insulating material. In a further embodiment of the invention, the insulating material includes a building paper surface layer thereby removing the need for a separate building wrap material. Building wrap or building paper is designed to prevent the passage of liquid water but allow for passage of water vapour, thereby allowing a wall cavity to breathe and enable evaporation of any ingressed rain water or condensation.

In a further embodiment of the invention the façade panel is secured to the panel support element by either mechanical or chemically means. Any suitable mechanical or chemical means suitable for securing the façade panel to the support element known to the person skilled in the art can be used. In the preferred embodiment of the invention the rear face of the façade panel is secured to the panel support element using adhesive.

In a further embodiment of the invention the panel retaining means is attached or secured to the structural substrate in a user determined position by fastening means, for example bolts, screws or rivets. It is understood that mechanical fastening means are provided with means to ensure that the fastening means are held securely in position on the structural substrate such that retaining element can bear loads whilst being held securely in position on the building structural substrate by the fastening means.

In a further embodiment of the invention, the façade system comprises an array of panel retaining means attached at user determined positions to the structural substrate.

In a further embodiment of the invention the panel retaining means comprise discrete sections or in elongate channel sections.

In a further embodiment of the invention, the panel retaining means comprise a plurality of elongate channel sections attached to a structural substrate in a first orientation and a plurality of discrete sections attached to the structural substrate in a second orientation intermediate to the elongate channel sections. In the preferred embodiment of the invention the discrete sections are attached to the structural substrate substantially orthogonal to the elongate channel sections.

In a further embodiment of the invention, the façade system comprises a pre-finished unit comprises at least one façade panel, at least two panel support elements and insulating material, wherein the insulating material is attached to the rear face of the façade panel interposed between the at least two panel support elements. The advantage of this embodiment of the invention is the façade panel unit(s) can be preassembled and delivered to a building site if so desired thereby reducing the amount of time required on site to complete installation of a thermally efficient façade. Conveniently further additional insulating material is installed on site prior to installing façade panels to fill gaps between the insulating material already present in preassembled façade panel units.

In a further embodiment of the invention, the panel retaining elements and/or panel support elements are preferably made from a suitable extruded metal, such as, aluminium, however any suitable metal or other material known to a person skilled in the art could also be used.

In a further embodiment of the invention, each said structural spacer element is substantially formed from at least one material selected from the group comprising that is substantially made from for example non-metallic materials such as glass fibre filled polymers, polypropylene, wood composites, wood, mineral materials, mineral filled polymers, and the like.

In one embodiment of the invention at least two panel support elements are required to fix a panel into a desired position within the façade construction. In a further embodiment of the invention four panel support elements are used, each adhered to the rear face of a panel, and each adjacent an edge. Optional additional supports may be used in intermediate positions to improve properties such as wind loading and for stiffening of very large panels. Once these are fixed in position, each non-fixed side arm of each "C" channel panel support element may be engaged with a respective panel retaining element to secure the panel into a desired, and user selectable position.

The use of continuous section panel retaining elements allows for construction of a weathertight façade system, where any water that ingresses through the panel joint positions, is containing within the channels formed by the flanges of the panel support elements and the panel retaining elements.

According to the invention, there is provided a method for installing a façade system suitable for attaching to a structural substrate comprising the steps of;

(a) installing panel retaining means comprising means for attaching the panel retaining means to the structural substrate and means for securing a panel support element to the panel retaining means, wherein the means for securing the at least one panel support element comprises a channel formation;

(b) coupling a façade panel comprising a front face and a rear face and an edge member intermediate to and contiguous to the front face and the rear face to a panel support element comprising a first arm, a second arm and a bridging portion intermediate the first and second arm, wherein the at least one panel support element is connected to the rear face of the at least one façade panel, and (c) installing a façade panel coupled to a panel support element by inserting the second side arm of panel support element into the channel formation.

According to the invention, there is also provided a method for installing a façade system suitable for attaching to a structural substrate comprising the steps of;

(a) installing a structural support element into a structural substrate;

(b) fixing a supporting bracket to the structural substrate;

(c) inserting a structural spacer element into supporting bracket;

(d) aligning the structural spacer element;

(e) inserting a support plate into the structural spacer element;

(f) adjusting the height of the support plate to a desired relative distance from the surface of structural substrate;

(g) mounting of panel retaining means comprising means for attaching the panel retaining means to the support plate and means for securing a panel support element to the panel retaining means, wherein the means for securing the at least one panel support element comprises a channel formation;

(h) installing insulating material between the structural substrate and the support plate;

(i) coupling a façade panel comprising a front face and a rear face and an edge member intermediate to and contiguous to the front face and the rear face to a panel support element comprising a first arm, a second arm and a bridging portion intermediate the first and second arm, wherein the at least one panel support element is connected to the rear face of the at least one façade panel, and (j) installing a façade panel coupled to a panel support element by inserting the second side arm of panel support element into the channel formation.

In a further embodiment of the invention, at least one façade panel is a fibre cement panel.

BRIEF DESCRIPTION OF THE DRAWINGS

The invention will now be described more particularly with reference to the accompanying drawings, which show by way of example only various embodiments of the façade system of the invention.

In the drawings.

DETAILED DESCRIPTION OF THE INVENTION

Figure 1:
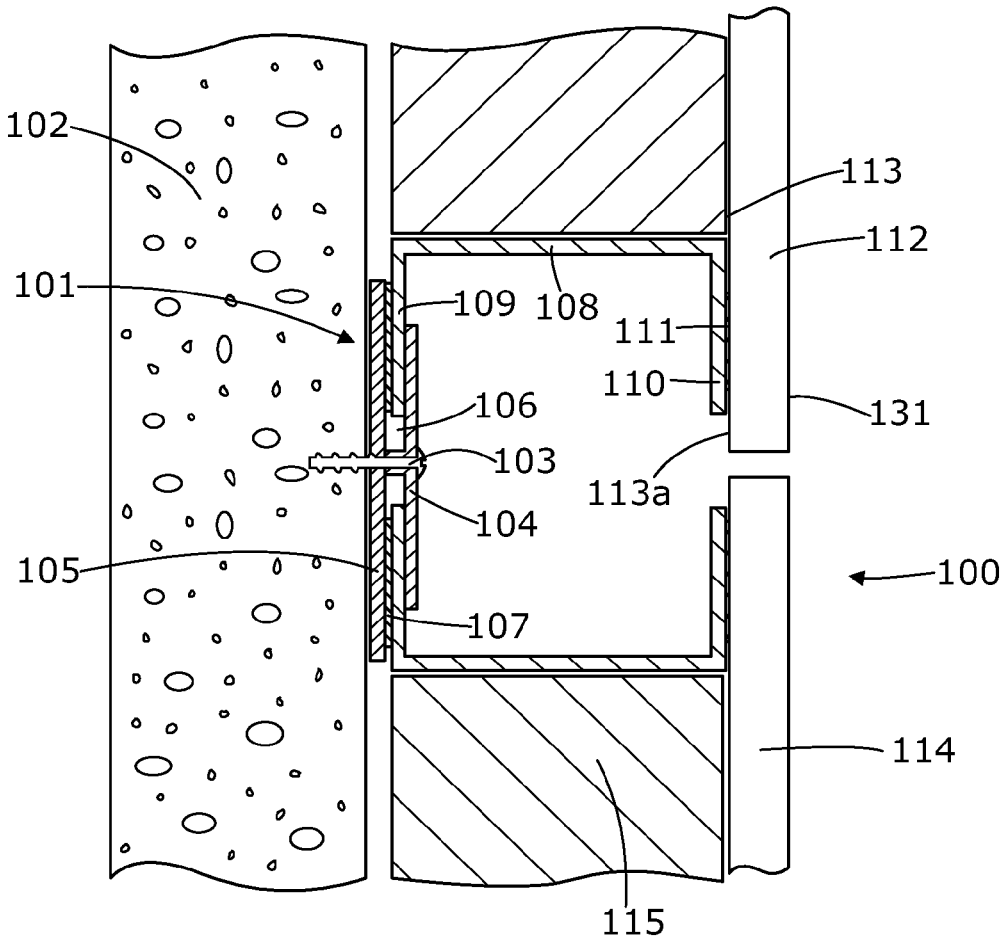
FIG. 1 is a cross-sectional side view of a section of a façade system according to a first embodiment of the invention.

Throughout the detailed description of the invention, the features of the invention that are common to each embodiment have the same two-digit reference numeral. The reference numerals are prefixed with a one or more further digits to indicate the embodiment of the invention being referred to.

Referring to the drawings and specifically FIG. 1, there is shown a façade system according to the first embodiment 100 of the invention. The façade system 100 comprises a retaining element 101 fixed to building structural substrate 102 in a user determined position by fastening means 103. In this embodiment of the invention the fastening means 103 comprises mechanical fastening means, in the form of a screw. Alternatively other types of fastening means that could be used include for example, bolts, screws or rivets. Although not shown, it is understood that mechanical fastening means 103 are provided with means to ensure that the fastening means 103 are held securely in position on the building structural substrate 102 such that retaining element 101 can bear loads whilst being held securely in position on the building structural substrate 102 by the fastening means 103.

Retaining element 101 comprises a first and second flange 104 and 105 respectively separated by an intermediate portion. The flanges 104 and 105 of the retaining element 101 and the intermediate portion form a U-shaped channel 106, whereby the flanges 104 and 105 define the arms of the U-shaped channel 106 and the intermediate portion defines the base of the U-shaped channel 106. The U-shaped channel 106 extends around the intermediate portion.

First and second façade panels 112 and 114 are mounted onto the retaining element 101 by means of a panel support element 108 such that the front face 131 of the façade panel forms the exterior component of the façade system 100. In the embodiment shown panel support element 108 is in the form of a "C" channel section, wherein the face of a first side arm 110 is chemically bonded using adhesive 111 to the rear face 113 of façade panel 112. Conveniently the "C" channel section is positioned on the rear face 113 of the façade panel such that there is a panel lip 113*a* provided between the end of the first side arm 110 and the panel edge. The panel lip 113*a* functions to provide an edging member between the panel support element 108 and the panel edge so that the panel support element 108 is not seen from the exterior face 131 of the façade panel 112, 114. The second side arm 109 of panel support element 108 is seated within channel 106. The second side arm 109 of the panel support element 108 is secured in position by securing means 107. In the embodiment of the invention shown, securing means 107 is an adhesive.

Figure 10:
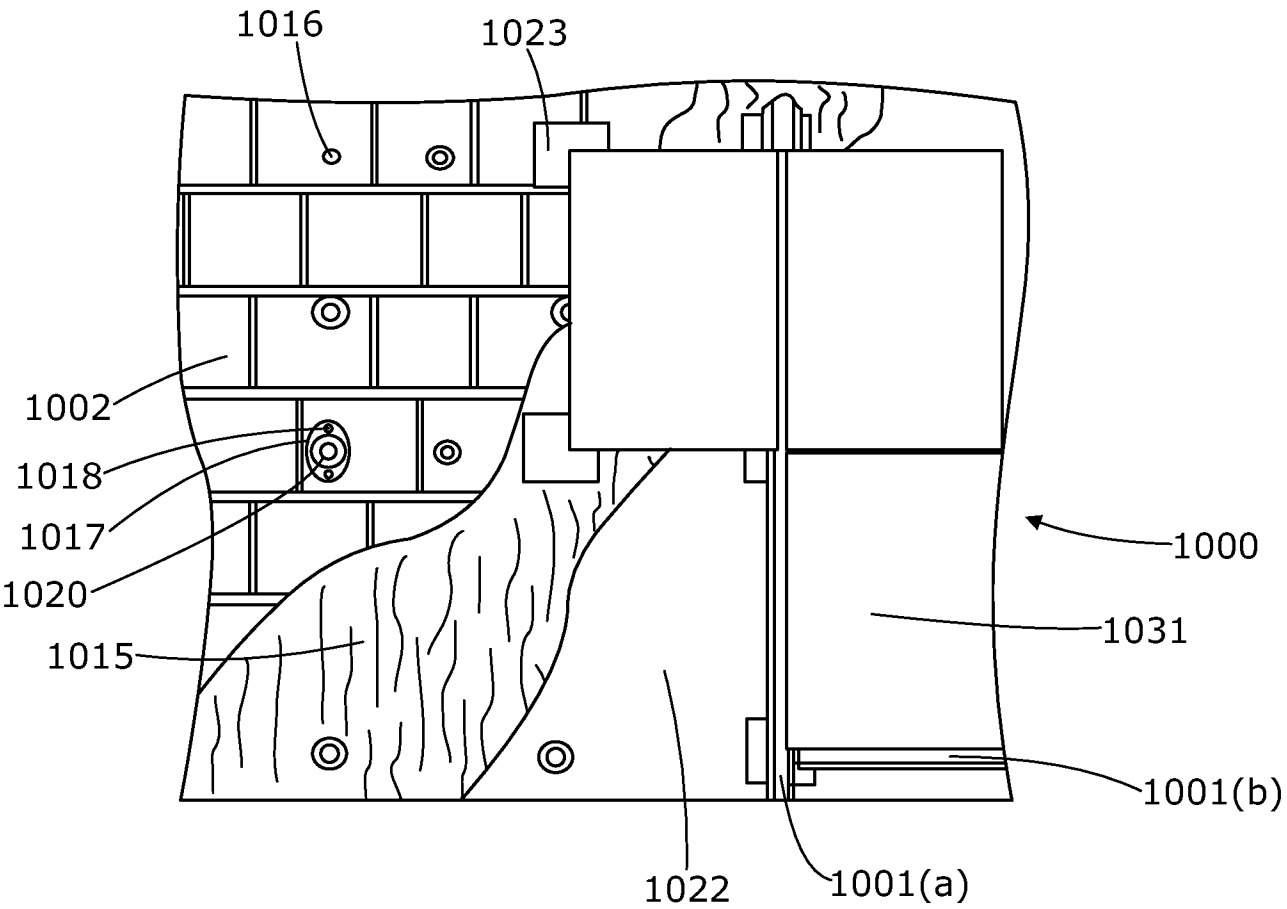
FIG. 10 is a partial cut-away front view of a thermally efficient façade system according to one embodiment of the invention.
Figure 11A:
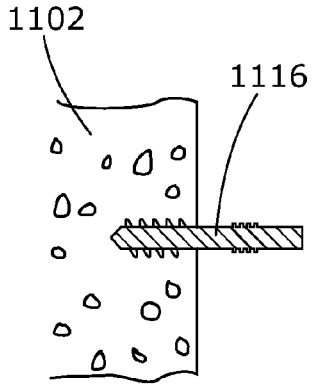
FIG. 11 (*a*) to (*g*) are cross-sectional side view of the stages when constructing a thermally efficient façade system in accordance with one embodiment of the invention.
Figure 11B:
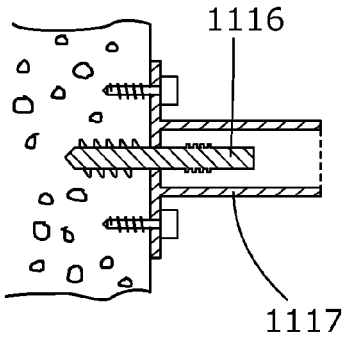
Figure 11C:
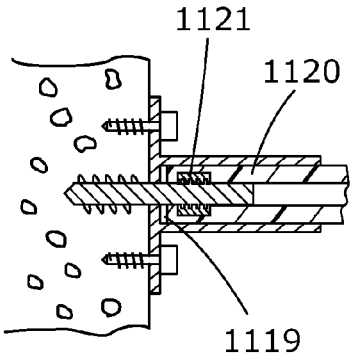
Figure 11D:
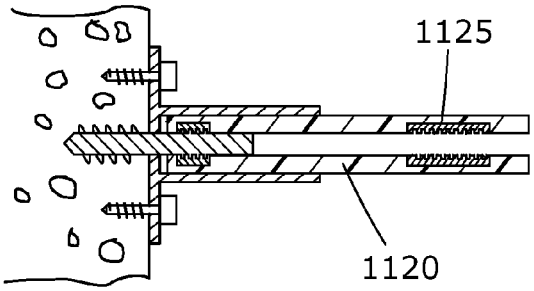
Figure 11E:
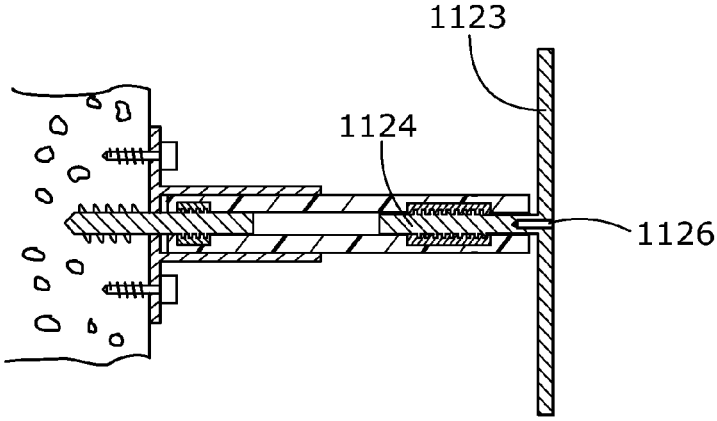
Figure 11G:
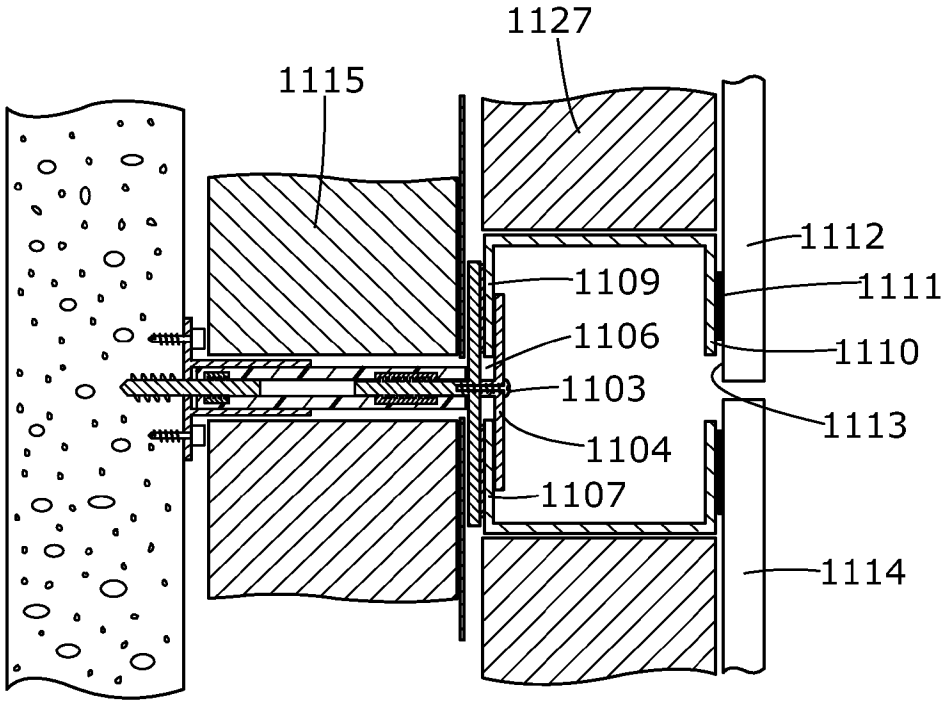
Figure 11F:
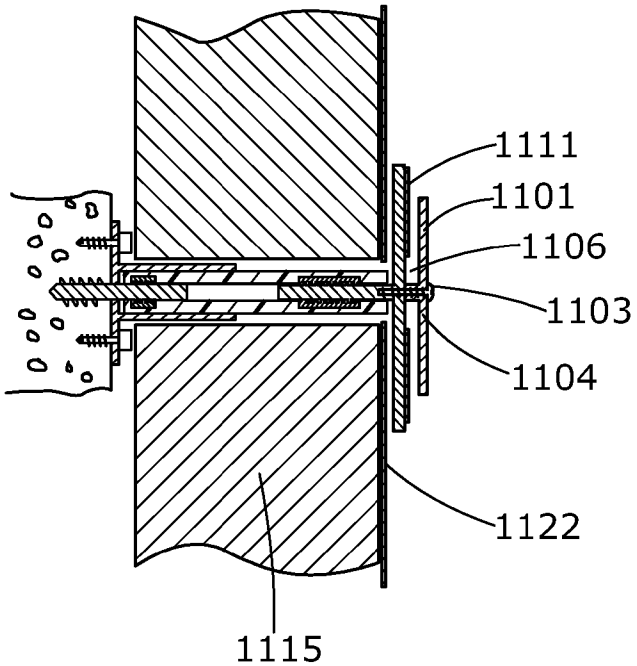

When the façade system 100 of the invention is used to provide a water tight exterior envelope around a building, the façade system comprises an array of retaining elements 101 attached at user determined positions to the building structural substrate 102. Retaining element 101 may be installed as discrete sections or in continuous channel sections. An example of this is shown in FIG. 10, where elongate sections of retaining element 1001 are installed vertically 1001(*a*), and discrete sections are installed horizontally 1001(*b*).

Second side arm 109 of panel support element 108 can be slid into channel 106 of retaining element 101. In installation of a façade 100, a starter strip may be used to retain the edge of the first panel or row of panels. Usually, this is the lower edge. A row of façade panels may be installed by inserting second side arm 109 of a panel supporting element 108 of each façade panel into the starter strip. Retaining element 101 may then be positioned to capture the second side arm 109 of panel retaining formation 108 across the upper edge of each of the row of façade panels. Retaining element 101 may be fastened to a support plate to provide a substantially rigid support for the installed row of façade panels.

In the façade system 100, insulating material 115 is also shown, for example, fibreglass batt insulation positioned between the building substrate 102 and the rear face 113 of the façade panels 112 and 114. It is to be understood that this is an optional addition to the façade system 100. Conveniently, insulating material 115 is provided with the appropriate thermal insulation performance as desired by the end user. The insulation material 115 shown in FIG. 1 is supported by the bridging portion between the first and second side arms 109 and 110 of the panel support element 108. The advantage of the insulating material is that it enhances the thermal performance of the façade system of the invention.

Figure 2:
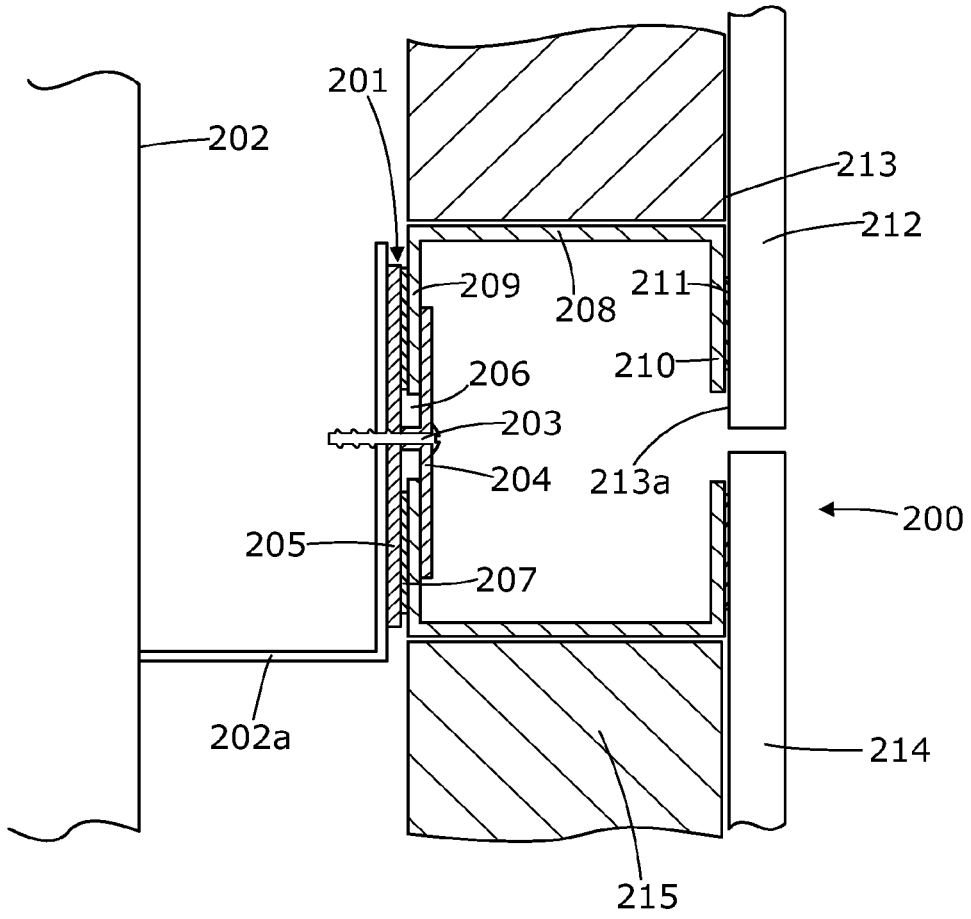
FIG. 2 is a cross-sectional side view of a section of a façade system according to a second embodiment of the invention.

Referring to FIG. 2, there is shown a second embodiment 200 of the façade system of the invention. In this embodiment of the invention the façade system the retaining element 201 is fixed to a horizontal structural substrate 202*a* extending between two vertical structural building substrates 202. In the embodiment shown the horizontal structural substrate 202*a* is in the form of a girt. It is to be understood that the horizontal structural substrate 202*a* is provided as a bracing member to the primary structure and any suitable shaped horizontal member with or without additional stabilising means can be used. The retaining element 201 is secured by a mechanical fastener 203 to the girt 202*a*. The remaining features of FIG. 2 are similar to those of FIG. 1.

Figure 3A:
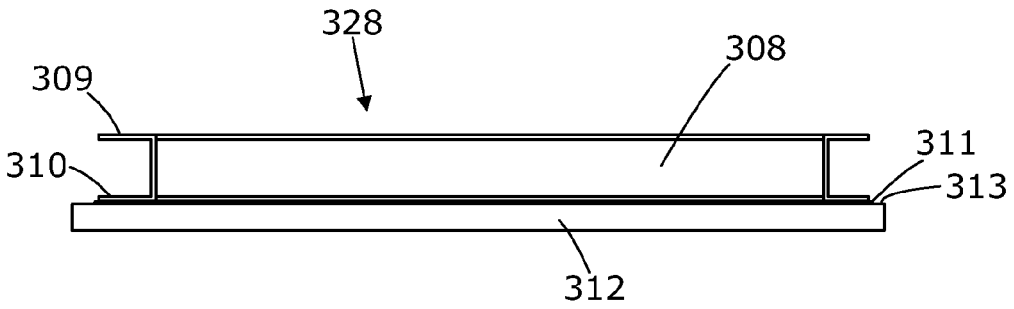
FIG. 3*a* is an end view of a panel with panel support elements attached according to a further embodiment of the invention.
Figure 3B:
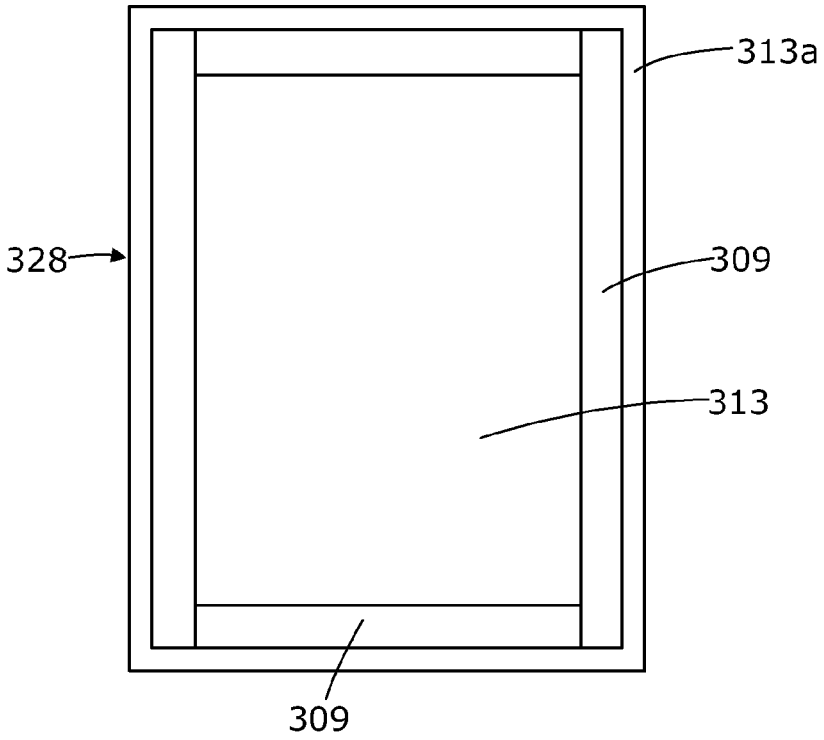
FIG. 3*b* is a rear view of the panel of FIG. 3*a;*

FIGS. 3(*a*) and 4(*a*) are end views of two embodiments of the panel support elements referred to as 308 and 408 respectively. In this embodiment of the invention the first and second side arms 309 and 310 comprise a continuous member extending between the "C" channel sections such that the panel support element 308 traverses the panel 312. Panel support element 308 of FIGS. 3(*a*) and 3(*b*) shows two "C" channel sections attached to the rear face 313 of the panel 312 by chemically adhering the panel support element 308 to the panel 312. The "C" channel section does not span the entire panel 312, there is provided a lip 313*a* between the end of the first arm 309 of the panel support member 308 and the panel edge to ensure that the panel support element 308 is not seen from the exterior face of the façade panel 312. Optionally multiple panel support elements 308 can be attached to the rear face 313 of the façade panel 312 to form a façade cassette 328 as shown in FIG. 3(*b*). In this embodiment shown there are four panel support elements 308 attached to the rear face 313 of the façade panel 312. The panel support elements 308 are arranged in a continuous or endless squared arrangement.

Figure 4A:
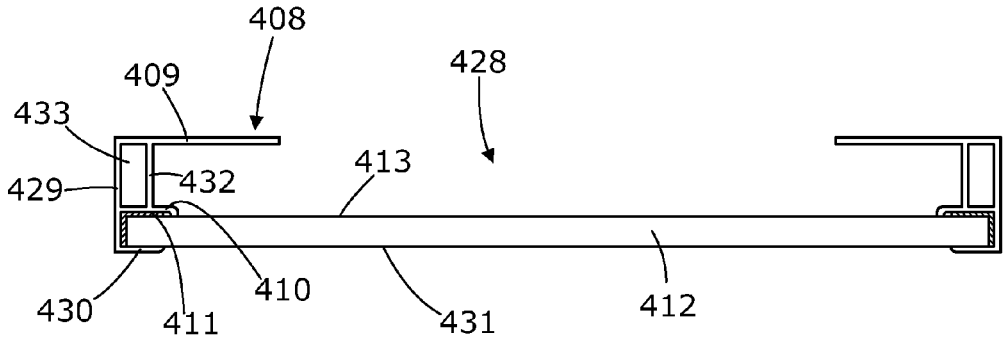
FIG. 4*a* is an end view of a panel with panel support elements attached according to a further embodiment of the invention.
Figure 4B:
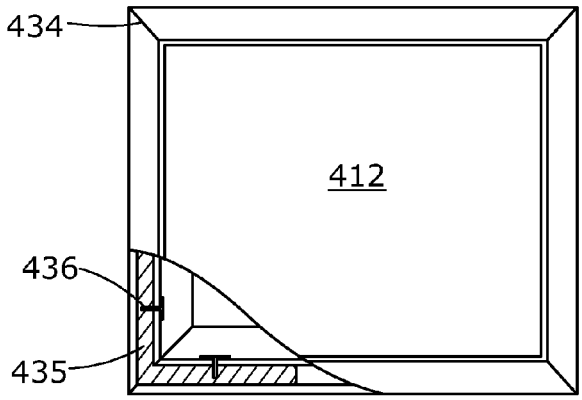
FIG. 4*b* is a partially cut away front view of the panel of FIG. 4*a;*

Referring now to FIGS. 4(*a*) and 4(*b*), there is shown a further embodiment of a panel support element 408. In this embodiment of the invention, the panel support element 408 is provided with capping means whereby the capping means is used to protect the edges of façade panel 412. The panel support element 408 is provided as a "J" channel section wherein the short side of the "J" shaped channel comprises the first side arm 410 and the elongate side of the "J" shaped channel comprises the second side arm 409. Intermediate the first side arm 409 and second side arm 410, there is provided a base member 429. In the embodiment shown there is a connecting web 432 provided between the first and second side arms 409 and 410 parallel to and spaced apart from base member 429, to form an enclosed box section 433. One advantage of the enclosed box section 433 is that it provides an air channel which further improves the thermal efficiency of the façade system of the invention. It is to be understood that this is an optional feature and is not necessarily present in other embodiments of the panel support elements of the invention.

Panel support element 408 is also provided with a third side arm 430 which projects orthogonally from base member 429. Conveniently the first side arm 410 and third side arm 430 are spaced apart from each other such that the first and third side arm 410, 430 and base member 429 form a second "U" shaped channel. Conveniently the first and third side arm 410 and 430 are spaced apart an appropriate distance to enable a façade panel 412 seat within the second "U" shaped channel. In the embodiment shown, adhesive 411 is provided on the section of the façade panel 412 seated within the "U" shaped channel to secure and hold the façade panel 412 in place. The end of first side arm 410 remote from base member 429 is also provided with a small protrusion or lip. The lip or protrusion is resiliently biased towards the façade panel 412. In this way the first side arm 410 acts to further support and retain the façade panel 412 in position in the panel support element 408.

Referring now to FIG. 4(*b*), there is shown a façade panel 412 which has been surrounded or framed by panel support elements 408 such that the façade panel 412 is enclosed by the panel support element 408 forming a façade cassette 428. For the purposes of this description, the panel support elements in FIG. 4(*b*) will be referred to as vertical and horizontal members of the frame which is used to surround façade panel 412. The ends 434 of the vertical and horizontal members have been mitre cut to allow the respective members to seat together in an aesthetically pleasing manner. Optionally, one or more corner connectors 435 comprising two lengths of material arranged at right angles relative to each other can be positioned within the enclosed box section 433 of adjoining horizontal and vertical members of the frame. In the embodiment shown, the corner connector 435 does not extend the entire length of either the vertical or horizontal member. This allows further corner connectors (not shown) to be placed at each respective corner of the frame. The or each corner connector 435 is held in place using corner fixings 436. The advantage of the corner connector 435 of FIG. 4(*b*) is that it provides additional support and strength to the panel support elements 434 when arranged in the frame structure shown.

Figure 5:
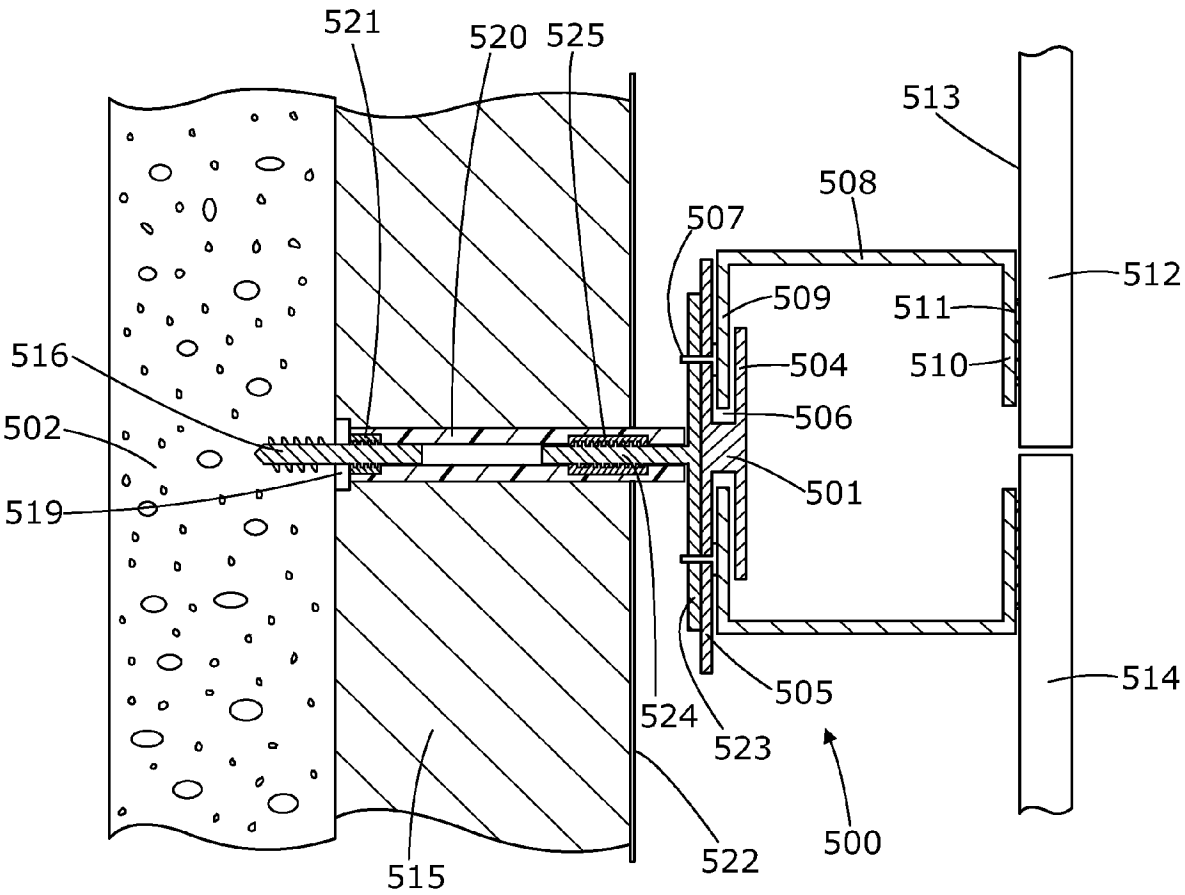
FIG. 5 is a cross-sectional side view of a section of a façade system according to a third embodiment of the invention.

In FIG. 5, there is shown a further embodiment 500 of the façade system of the invention. This embodiment of the invention differs from those of FIGS. 1 and 2 in that the retaining element 501 is connected to the structural building substrate 502 by means of an optional structural spacer element 520.

A structural support element 516 is installed into the structural building substrate 502. An optional spacer element 519 may then be placed over each structural support 516 before structural spacer elements 520 are mounted onto the structural support element 516. The optional spacer element 519 comprises, for example, a rubber or polymeric washer. The optional spacer element 519 functions to improve the ease of tightening of structural spacer element 516.

In the embodiment shown the structural support element 516 is integrally formed with the structural spacer element 520. Optionally, the structural support element 516 and structural spacer element 520 are preassembled together by the manufacturer. Each of the structural spacer element 520 and structural support element 516 are provided with mutually enageable threaded portions 521. Conveniently the structural spacer element 520 is installed by rotating the threaded portion 521 with the threaded portion on structural support element 516. Structural support element 516 may be screwed into masonry wall or building substrate 502 until tight. Each structural spacer element 520 is tightened against optional spacer element 519, if used.

Once structural spacer element 530 is fixed into position and its orientation aligned, the process can be repeated at other user selectable positions across the face of a section of building substrate 502 to provide an array of locations that will support the installed façade. Insulating material 515 may be installed at this point. Suitable insulating materials include foamed panelized insulating material, for example, polyurethane foamed panelized insulating material, mineral or glass wool or other suitable insulating materials. The selected insulating material may be installed to substantially cover the wall section of building substrate 502 that is to be clad. Insulating material 515 is positioned such that it butts up against the structural spacer element 516. It is understood that the insulating material is installed in line with manufacturer's recommendations and leaves as little uncovered space as possible. It is preferable that no gaps are left between the insulating material 515 and the structural building substrate 502 that may detract from thermal performance of the completed façade.

Building wrap 522 is optionally installed over the insulating material 515, with minimally sized perforations made to accommodate the protruding ends of structural spacers 520. Although not shown in an alternative embodiment of the invention the insulating material 515 includes a building paper surface layer thereby removing the need for a separate building wrap material.

The support plate 523 has a "T" configuration in cross-section and comprises a support surface attached to support shaft 524. The structural spacer element 520 and support shaft 524 have mutually engageably threaded portions 525 which releasably engage with each other. Conveniently this feature enables the support plate 523 to be wound in or out to allow for adjustment to the position of the support plate 523 relative to the surface of structural building substrate 502 whilst also providing a substantially planar surface for mounting the retaining element. Support plate 523 is mounted to each structural spacer element 520. Shaft 524 of support plate 523 is inserted into the central aperture of spacer element and engaged with second threaded portion 525. The relative distance of support plate 523 from building substrate 502 may be adjusted by controlling the relative depth of engagement of the treaded portion of shaft 511 with second threaded portion 512 of structural spacer element 506. The structural spacer element 516 is sized such that it projects a sufficient distance from the surface of structural building substrate 502 and the surface of insulating material 515 to allow the retaining element to be securely attached to the structural spacer element 516. Once adjusted to a desired position, an optional additional nut (not shown) positioned on shaft 524 may be used to lock support plate 523 at that position and prevent movement during installation of façade panels 512, 514, particularly if using discrete panel retaining elements 501 rather than elongate sections that may span several support plates 523.

When the support plate 523 is in position, retaining element 501 is fixed to it mechanically by securing means, for example, bolts, screws or rivets (not shown). Panel support elements 508 are attached to rear face 513 of façade panels 512 and 514 and seated within channel 506 as previously described. As before retaining element 501 may be installed as discrete sections or in continuous channel sections. The relative height of each supporting plate 523 is adjusted so that the surface of all supporting plates forms a planar array across the wall section. Adjustment of the relative height of supporting plated 523 provides a planar surface onto which the façade can be mounted to provide a planar façade surface with minimal difficulty.

Retaining element 501 is fixed to support plate 523 by screw 507 which extends into shaft 524 of support plate 523. Retaining element 501 may be in the form of an extruded metal profiled section comprising first flange 504 and second flange 505 which is mounted against support plate 523. Second flange 505 extends substantially parallel to first flange 504. Optionally, at least one end of second flange 505 terminates in a formation designed to increase resistance of fit of façade panel units during installation to ensure a tight fit of the façade unit to the support structure.

Conveniently structural spacer elements 520 shown in this embodiment of the invention are installed at intermediate panel positions in addition to corner support positions.

Figure 6:
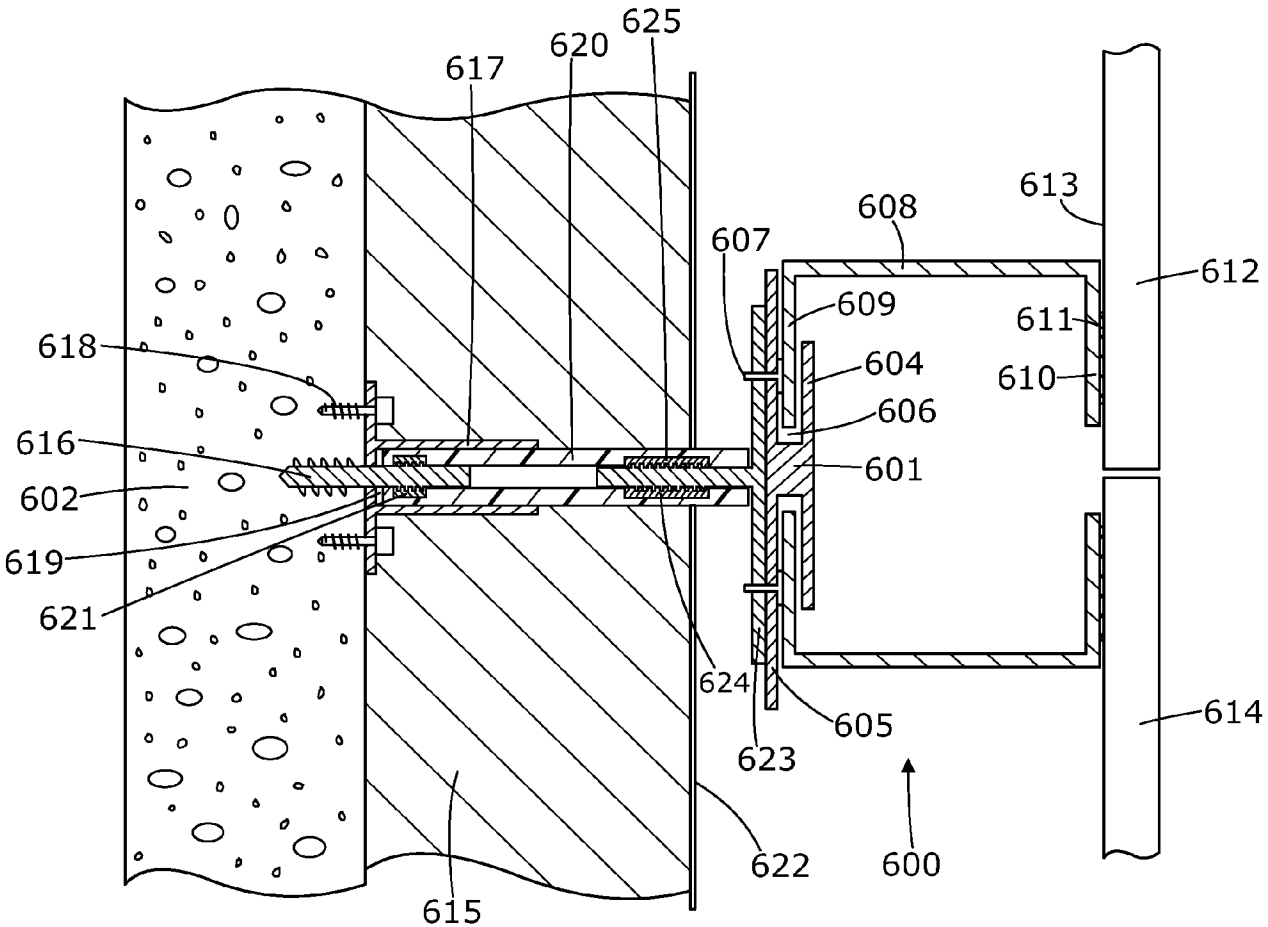
FIG. 6 is a cross-sectional side view of a section of a façade system according to a fourth embodiment of the invention.

Referring now to FIG. 6, there is shown a further embodiment of the façade system 600 of the invention. This embodiment of the invention is similar to that of FIG. 5 however a support bracket 617 is mounted over the protruding part of structural support element 620. The support bracket 617 is fixed in place by mounting bolts 618 which are secured directly into substrate 602. Bolts 618 may be used to adjust the tilt of support bracket 617 to take into account any surface variability in the masonry wall or building substrate 602 and ensure the required alignment of structural spacer element 616. Bolt 618 is a normal threaded bolt and may be mounted to supporting bracket 617 by inserting it into a threaded aperture in the base flange of supporting bracket 617. By tightening bolt 618 its threaded portion will extend beyond the base of supporting bracket 617 and will apply pressure against building substrate 602. As bolt 618 is progressively tightened, the resistance of building substrate 602 to the applied pressure will cause supporting bracket 617 to tilt, thereby enabling a degree of adjustment of tilt of supporting bracket 617. More than one bolt 618 may be used on each supporting bracket 503 to enable tilt to be adjusted in more than one axis.

In this embodiment of the invention the structural spacer element 620 is mounted over the structural support element 616 which is contained within the central apertures of each support bracket 617. When structural spacer element 620 in inserted into support bracket 617, structural spacer element 620 is substantially perpendicular to the intended plane of the façade system 600. Structural spacer element 620 has a structural support element 616 integrally formed or preassembled by its manufacturer. Optional spacer 619, such as rubber or polymeric washers, may be fitted into the base of supporting bracket 617 to improve the ease of tightening of structural spacer element 620. Structural support element 616 may be inserted through supporting bracket 617 and screwed into masonry wall substrate 602 until tight. The remaining features of the façade system of this embodiment are similar to those of FIG. 5.

Figure 7:
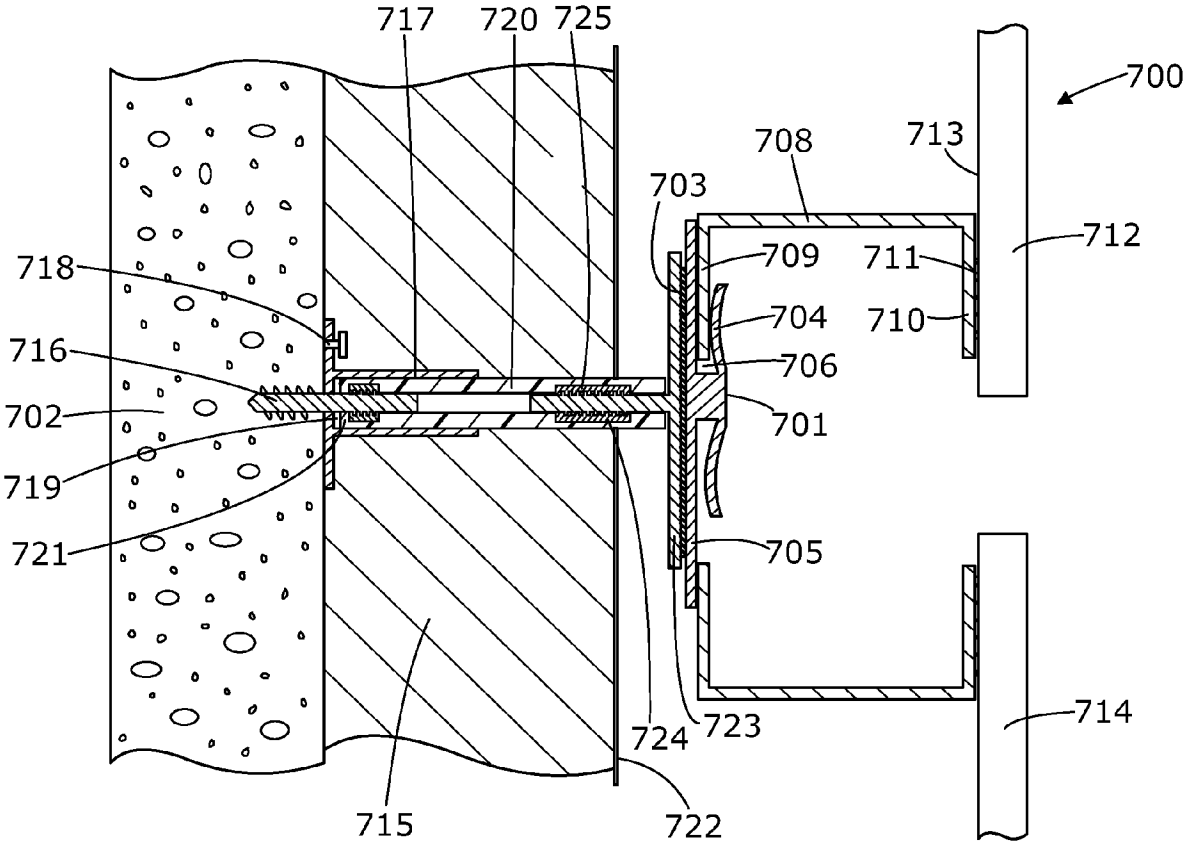
FIG. 7 is a cross-sectional side view of a section of a façade system according to a fifth embodiment of the invention.

FIG. 7 shows yet another embodiment of the façade 700 of the present invention, wherein at least one or more of support brackets 717 are used without being chemically or mechanically fixed directly to structural building substrate 702. They are instead held in place by the combined positioning of the support bracket 717 over structural support 716 and the releasable engagement of the threaded portions of the structural spacer element 720 with the structural support element 716. Tensioning screws 718 are optionally provided to adjust the angle of support bracket 717 and thereby also adjust the angle of structural spacer element 720 relative to structural building substrate 702.

Panel retaining element 701 is fixed to support plate 723 by securing means 703 which in this instance is adhesive. A portion of first flange 704 is biased towards second flange 705 forming a restricted portion of channel 706. When second side arm 709 of panel support element 708 is urged into the restricted portion of channel 706, first flange 704 is resiliently biased away from second flange 705 resulting in second flange 705 acting as a resiliently biased spring on second side arm 709 to retain it in its installed position. FIG. 7 shows a first panel 712 in an installed position and a second panel 714 in position ready to be installed, whereby the second side arm of the second panel support element will be urged into the restricted portion of channel 706.

Figure 8:
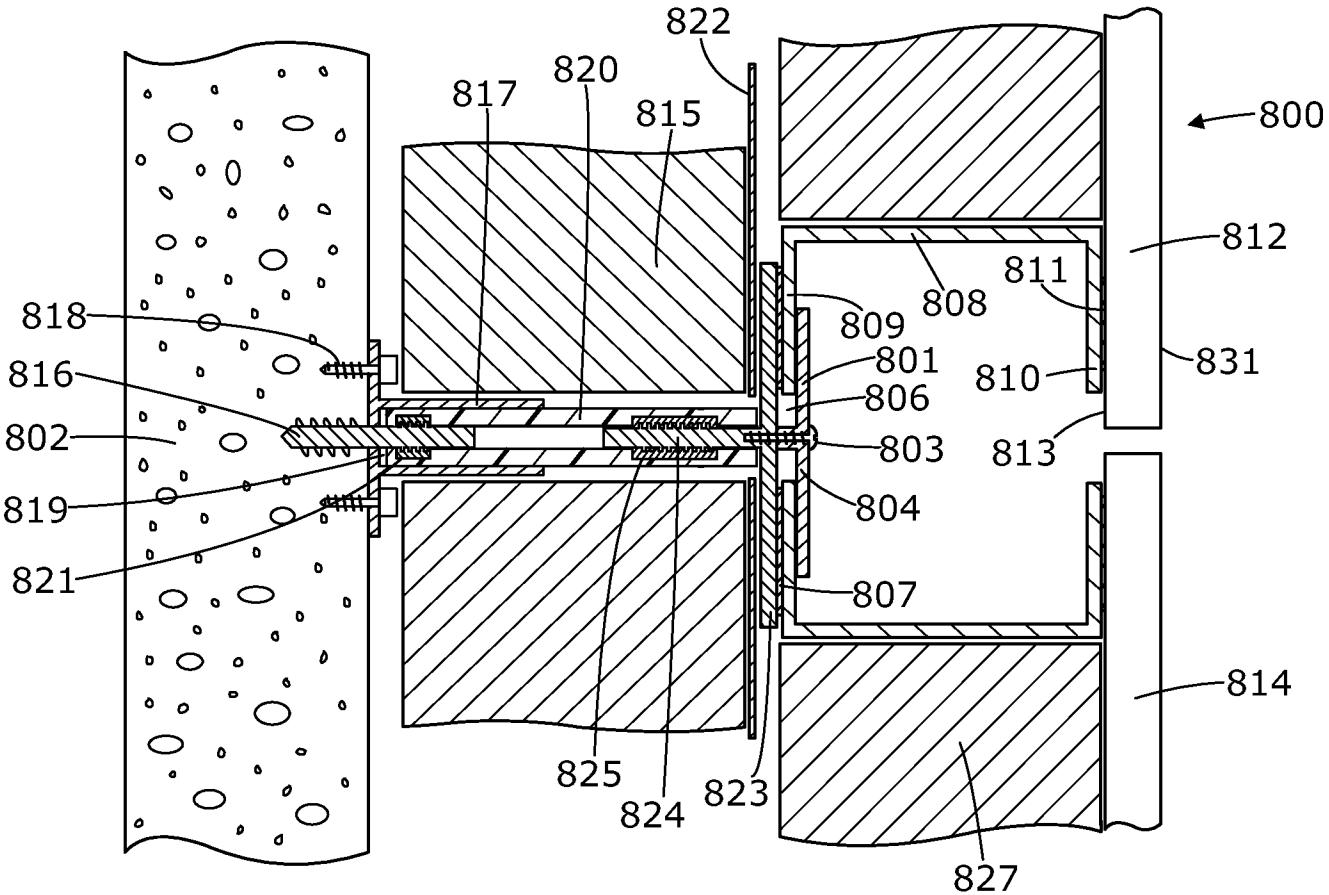
FIG. 8 is a cross-sectional side view of a section of a façade system according to a sixth embodiment of the invention.

FIG. 8 shows a cross-sectional view of a further embodiment 800 of a thermally efficient façade system of the invention. In this embodiment of the invention, panel retaining element 801 comprises a "T" section and channel 806 is formed between support plate 823 and panel retaining element 801. Panel retaining element 801 is fastened to support plate 823 by mechanical fastener 803. Support plate 823 is attached to structural spacer element 820 by means of the mutually engaging threaded portion 825. As before the structural spacer element 820 is secured to the structural support element 816 by mutually engaging threaded portions 521. The structural support element 816 is secured in position by means of a supporting bracket 817 which is secured in position by securing means 818. Insulating material 815 is disposed between the supporting bracket 817 and the supporting plate 823. Building wrap 822 is provided on the face of the insulating material 815 remote from the building substrate 802.

In this embodiment of the invention, the façade panels 812 and 814 are provided together with at least two panel support elements 808 and insulating material 827 as prefinished units, wherein the insulating material is interposed between the at least two panel support elements 808. In this embodiment of the invention 800, the façade panel unit(s) can be preassembled and delivered to a building site if so desired thereby reducing the amount of time required on site to complete installation of a thermally efficient façade. Further additional insulating material 815 can be installed on site prior to installing façade panels 812 to fill gaps between insulating material 827 in preassembled façade panel units.

Figure 9:
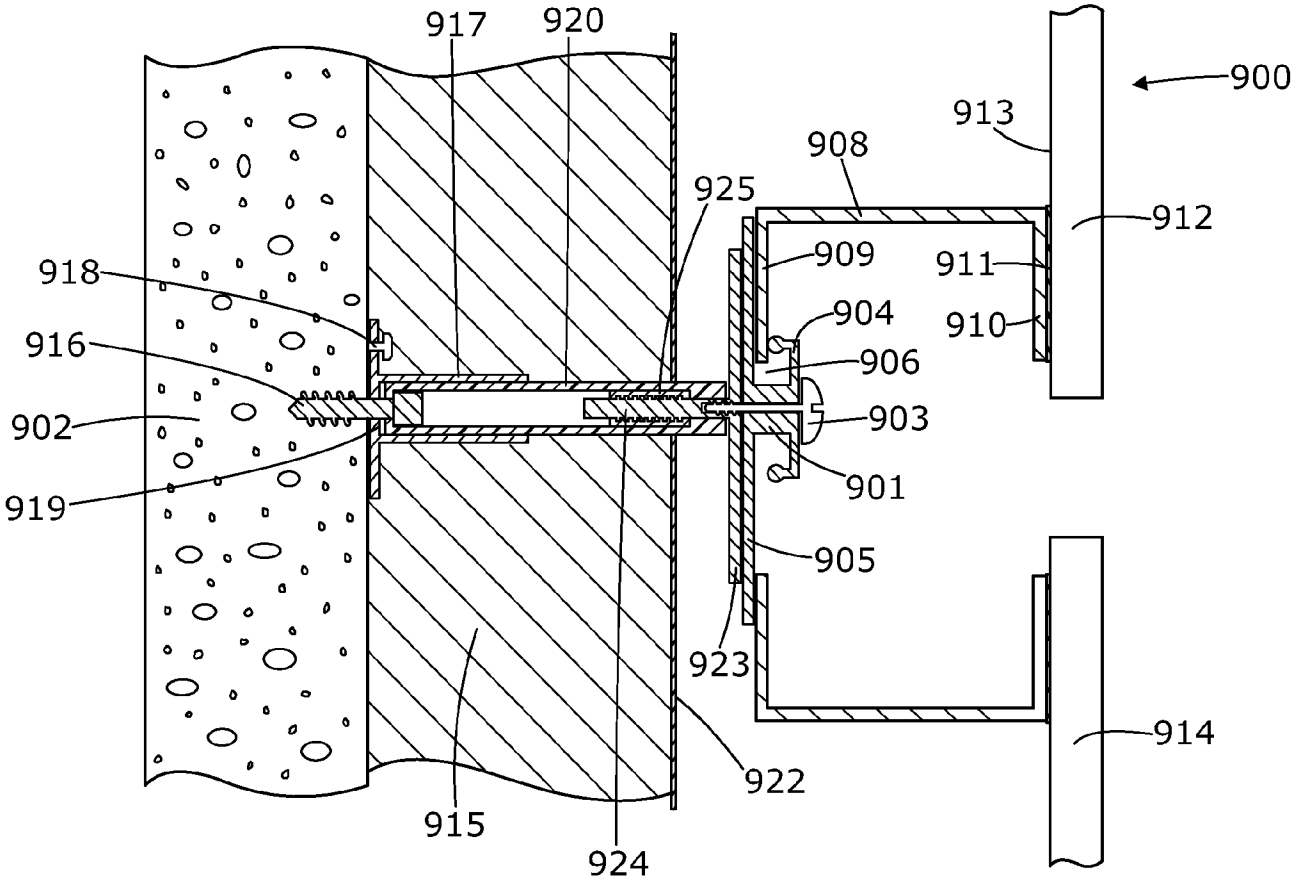
FIG. 9 is a cross-sectional side view of a section of a façade system according to a seventh embodiment of the invention.

Referring now to FIG. 9, there is shown a further embodiment of the invention 900. This embodiment of the invention is very similar to the embodiment of the invention shown in FIG. 7. The support brackets 917 shown in FIG. 9 are also secured to the structural building substrate 902 without the use of chemically or mechanically fixing means. As before, the support bracket 917 is held in place by means of the structural support element 916 which also secures the structural spacer element 920 is position.

The retaining element 901 has a further design modification whereby the end of first flange 904 remote from the base member of the U-shaped channel 906 comprises a projection extending orthogonally therefrom. The projection extends in parallel with the base member of the U-shaped channel 906 pointing towards the second flange member 905. The projection is resiliently biased towards the second flange member 905 to provide a resistance or friction fit when the second side arm 909 of panel support element 908 is inserted into the channel 906. In the embodiment shown the projection further comprises an optional enlarged end to enhance the performance of this embodiment of the invention.

The structural support element 916 and the structural spacer element 919 of FIG. 9 are not provided with mutually engaging threaded portion. In this embodiment of the invention the structural support element 916 is in the form of a bolt which is secured directly to the structural building substrate 902.

FIG. 10 shows a partial cutaway front view of a thermally efficient façade 1000 constructed according to one embodiment of the invention, wherein structural support elements 1016 are fixed to structural building substrate 1002, in this case, an existing masonry wall construction. Structural support elements 1016 may be bolts, chemical anchors, masonry anchors and the like, that have a portion for engaging the structural building substrate 1002 and a portion for engaging at least a structural spacer element 1020. Alternate structural support element 1016 in both the horizontal and vertical plane of structural building substrate 1002 have a support bracket 1017 positioned and fixed to the structural building substrate using bolts 1018. Spacer elements (not shown), such as washers, are positioned over each structural support element 1016 and a respective structural spacer element 1020 engaged and rotated to bring threaded portion of structural support 1016 into releasable engagement with a first threaded portion of structural spacer element 1020.

Structural spacer elements 1020 are formed from nonmetallic materials such as glass fibre filled polymers, polypropylene, wood composites, wood, mineral materials, mineral filled polymers, and the like. Any materials with a low thermal conductivity and sufficient structural strength to meet the requirements of static and dynamic loading encountered in installation and in service are suitable.

Structural spacer elements 1020 also provide a break in thermal conduction between metal support and retaining elements and the structural support elements 1016 fixed to the structural building substrate 1002, thereby reducing thermal conduction between the exterior or front face of the façade 1031 and the structural building substrate 1002 in the constructed façade system 1000.

Insulating material 1015 such as glass fibre batts, polystyrene insulating panels or the like, user selectable to meet local building code requirements, are positioned between installed structural spacer elements snugly, so that no large open gaps exist which would detract from the thermal insulation efficiency of the façade. Over the top of the insulating material 1015, a building wrap or budding paper 1022 is installed. Budding wrap or building paper is designed to prevent the passage of liquid water but allow for passage of water vapour, thereby allowing a wall cavity to breathe and enable evaporation of any ingressed rain water or condensation.

Each support plate 1023 is positioned by engaging a threaded portion on its shaft with a respective second threaded portion of a structural spacer element. The relative distance of the support plate away from the structural budding substrate is adjustable by controlling the depth of the engagement of the support plate with the second threaded portion of each respective structural spacer. In this way, any variability in the flatness of the structural building substrate 1002 can be taken into account, and the relative height of the support plates 1023 can be controlled.

Once the height of each support plate 1023 has been set, the panel retaining elements 1001(*a*), 1001(*b*) can be fixed in position. Panel retaining elements are in the form of continuous extruded channel "H", "C" or "T" sections that may be fixed chemically or mechanically to support plates 1023. In this example, they are glued to the support plates 1023 by a suitable construction grade adhesive (not shown). At least one channel in each panel retaining element 1001(*a*) and 1001(*b*) may comprise at least one resiliently biased arm, for providing additional frictional support to an installed façade panel. The panel retaining elements and/or panel support elements are preferably made from a suitable extruded metal, such as, aluminium, however any suitable metal or other material known to a person skilled in the art could also be used.

Once panel retaining elements 1001(*a*), 1001(*b*) are in place, panel support elements (not shown) are either chemically or mechanically fixed to the rear face of each façade panel. In one embodiment of the invention at least two panel support elements are required to fix a panel into a desired position within the façade construction. In a further embodiment of the invention four panel support elements are used, each adhered to the rear face of a panel, and each adjacent an edge. Optional additional supports may be used in intermediate positions to improve properties such as wind loading and for stiffening of very large panels. Once these are fixed in position, each non-fixed side arm of each "C" channel panel support element may be engaged with a respective panel retaining element 1001(*a*), 1001(*b*) to secure the panel into a desired, and user selectable position.

In a further embodiment of the invention, the central flange of the "C" channel section may be perforated to allow ventilation of at least the portion between the insulating material 1015 and rear face of each installed façade panel.

The use of continuous section panel retaining elements allows for construction of a weather tight façade system, where any water that ingresses through the panel joint positions, is containing within the channels formed by the flanges of the panel support elements and the panel retaining elements.

FIG. 11 shows an installation sequence (not including insulating materials or building wrap in views (a) to (f)) comprising (a) installation of structural support element 1116 into building substrate 1102; (b) fixing of supporting bracket 1117 to building substrate 1102 by bolts 1118; (c) insertion of structural spacer element 1120 into supporting bracket 1117, engagement of threaded portion 1121 of structural spacer element 1120 with a corresponding portion on structural support element 1116 and tightening; (d) aligning structural spacer element 1120; (e) insertion of shaft 1124 of support plate 1123 and height adjustment to a desired relative distance from the surface of building substrate 1102; (f) mounting of retaining element 1101 and insulating material 1115; and (g) insertion of second side arm 1109 of panel support element 1108 of panels 1112 and 1114 into channel 1106 thereby completing the installation.

It will of course be understood that the invention is not limited to the specific details described herein, which are given by way of example only, and that various modifications and alterations are possible within the scope of the invention as defined in the appended claims.

The invention claimed is:

1. A facade system suitable for attaching to a structural substrate comprising;

(a) a structural substrate, and at least one facade panel comprising a front face and a rear face and an edge member intermediate to and contiguous to the front face and the rear face, (b) at least one panel support element positioned between the structural substrate and the rear face of the façade panel, said panel support element having a first arm, a second arm extending in the same direction as the first arm, and a bridging portion intermediate the first and second arm, said bridge portion having an exterior surface and an interior surface, wherein the first arm of the at least one panel support element is connected to and positioned entirely behind the rear face of the facade panel such that a panel lip extends between the end of the first arm and the edge member of the façade panel, wherein the exterior surface of the bridge portion of the panel support element, the structural substrate, and the rear face of the façade panel together define an insulation space, (c) at least one panel retaining element comprising a channel formation configured to receive the second arm of the panel support element, said panel retaining element being attached to the structural substrate and securing the panel support element to the structural substrate by securing the second arm of the panel support element inside the channel formation, wherein a space is formed between the panel retainer element and the first arm that is substantially the width of the bridging portion, and (d) a foam insulating material, said foam insulating material disposed in the insulation space between the structural substrate and the façade panel.

2. A facade system as claimed in claim 1, wherein the channel formation of the panel retaining element comprise a first and second flange separated by an intermediate portion.

3. A facade system as claimed in claim 2, wherein the first and second flanges extend substantially parallel to each other.

4. A facade system as claimed in claim 2, wherein the first and second flanges of the retaining element and the intermediate portion form a U-shaped channel whereby the flanges define the arms of the U-shaped channel and the intermediate portion defines the base of the U-shaped channel.

5. A facade system as claimed in claim 2, wherein the first flange is biased towards second flange forming a restricted portion of the channel formation.

6. A facade system as claimed in claim 5, wherein the second flange acts as a resiliently biased spring on second side arm of the panel support element.

7. A facade system as claimed in claim 2, wherein the second flange terminates in a formation designed to increase the resistance of fit of the second arm of panel support element within the channel formation.

8. A facade system as claimed in claim 1, wherein the panel retaining element further comprises spacing means intermediate the panel retaining element and the structural substrate.

9. A facade system as claimed in claim 8, wherein the spacing means comprises a structural support element and a structural spacer element.

10. A facade system as claimed in claim 9, wherein each of the structural spacer element and structural support element are provided with mutually engageable threaded portions.

11. A facade system as claimed in claim 8, wherein the spacing means further comprises a support bracket.

12. A facade system as claimed in claim 11, wherein the support bracket is fixed in place by bracket securing means whereby the bracket securing means are used to adjust the tilt of support bracket to take into account any surface variability in the masonry wall or building substrate.

13. A facade system as claimed in claim 9, wherein the panel retaining element further comprises a support plate intermediate the panel retaining means and the structural spacer element.

14. A facade system as claimed in claim 13, wherein the support plate comprises a support surface attached to a support shaft, the panel retaining element being attachable to the support plate and the support shaft being engageably with the structural spacer element.

15. A facade system as claimed in claim 14, wherein the structural spacer element and support shaft have mutually engageably threaded portions which releasably engage with each other.

16. A facade system as claimed in claim 15, wherein the support plate further comprises locking means for locking the support plate at a desired position and preventing movement during installation of facade panels.

17. A facade system as claimed in claim 1, wherein the panel support element is in the form of a "C" channel section.

18. A facade system as claimed in claim 17, wherein the facade system comprises two panel support elements for each facade panel.

19. A facade system as claimed in claim 18, wherein the first and second side arms on the panel support members comprise a continuous member extending between the respective "C" channel sections.

20. A facade system as claimed in claim 1, wherein the panel support element further comprises a connecting web between the first and second side arms parallel to and spaced apart from base member, thereby forming an enclosed box section.

21. A facade system as claimed in claim 20, wherein the panel support element further comprises a corner connector comprising two lengths of material arranged at right angles relative to each other.

22. A facade system as claimed in claim 21, wherein the interior of the box section and the corner connectors have complimentary engaging portions disposed on the surfaces of the interior of the box section and the corner connectors.

23. A facade system as claimed claim 1, wherein the panel support element further comprises capping means.

24. A facade system as claimed in claim 23, wherein the panel support element comprises a "J" channel section wherein the short side of the "J" shaped channel comprises the first side arm and the elongate side of the "J" shaped channel comprises the second side arm of the panel support element;

intermediate the first side arm and second side arm is provided a base member;

and a third side arm spaced apart from the first side arm and projecting orthogonally from base member thereby forming a second "U" shaped channel.

25. A facade system as claimed in claim 24, wherein the first and third side arm are spaced apart an appropriate distance to enable a facade panel seat within the second "U" shaped channel.

26. A facade system as claimed in claim 25, wherein the third side arm comprises a recess on the surface of the arm remote from the "U" shaped channel.

27. A facade system as claimed in claim 26, wherein the end of first side arm remote from base member comprises a resilient member in the form of a small protrusion or lip.

28. A facade system as claimed in claim 1, wherein multiple panel support elements are attached to the rear face (413) of the facade panel to form a facade cassette (428).

29. A facade system as claimed in claim 1, wherein the facade system further comprises insulating material positioned between the structural substrate and the rear face of the facade panel.

30. A facade system as claimed in claim 29, wherein the facade system of the invention further comprises building wrap installed over the insulating material.

31. A facade system as claimed in claim 1, wherein the facade system comprises an array of panel retaining means attached at user determined positions to the structural substrate.

32. A facade system as claimed in claim 31, wherein the panel retaining means comprise a plurality of elongate channel sections attached to a structural substrate in a first orientation and a plurality of discrete sections attached to the structural substrate in a second orientation intermediate to the elongate channel sections.

33. A facade system as claimed in claim 32, wherein the facade system comprises a pre-finished unit comprising at least one facade panel, at least two panel support elements and insulating material, wherein the insulating material is attached to the rear face of the facade panel interposed between the at least two panel support elements.

34. A facade system as claimed in claim 1, wherein the at least one facade panel is a fibre cement panel.

35. The façade system of claim 1, wherein the at least one façade panel is positioned entirely in front of the at least one panel support element.

* * * * *